US010751593B2

(12) United States Patent
Brown

(10) Patent No.: US 10,751,593 B2
(45) Date of Patent: Aug. 25, 2020

(54) STRENGTH TRAINING DEVICE FOR SWINGABLE SPORTS EQUIPMENT

(71) Applicant: Dewfall Development LLC, Manchester, NH (US)

(72) Inventor: Gary F Brown, Manchester, NH (US)

(73) Assignee: Dewfall Development LLC, Manchester, NH (US)

( * ) Notice: Subject to any disclaimer, the term of this patent is extended or adjusted under 35 U.S.C. 154(b) by 0 days.

(21) Appl. No.: 16/141,108

(22) Filed: Sep. 25, 2018

(65) Prior Publication Data

US 2019/0091536 A1 Mar. 28, 2019

Related U.S. Application Data

(60) Provisional application No. 62/562,571, filed on Sep. 25, 2017.

(51) Int. Cl.

| | |
|---|---|
| ***A63B 69/00*** | (2006.01) |
| ***A63B 21/00*** | (2006.01) |
| ***A63B 60/24*** | (2015.01) |
| ***A63B 21/06*** | (2006.01) |
| ***A63B 1/00*** | (2006.01) |
| *A63B 102/18* | (2015.01) |

(52) U.S. Cl.

CPC ..... *A63B 69/0002* (2013.01); *A63B 1/00* (2013.01); *A63B 21/0004* (2013.01); *A63B 21/0604* (2013.01); *A63B 60/24* (2015.10); *A63B 2069/0008* (2013.01); *A63B 2102/18* (2015.10)

(58) Field of Classification Search

CPC . A63B 69/0002; A63B 60/24; A63B 21/0004; A63B 21/0604; A63B 2102/18; A63B 2069/0008; A63B 69/00; A63B 69/0024; A63B 69/3632; A63B 69/38

USPC ..... 473/437, 422, 457, 564, 568, 521, 538, 473/231, 297, 44; D21/753, 725, 727

See application file for complete search history.

(56) References Cited

U.S. PATENT DOCUMENTS

| | | | | |
|---|---|---|---|---|
| 2,091,458 A * | 8/1937 | Sleight | A63B 53/14 473/568 |
| 2,244,351 A * | 6/1941 | Venables | A63B 21/0728 482/107 |
| 3,177,551 A * | 4/1965 | Engman | F16L 23/06 24/270 |
| 3,469,839 A * | 9/1969 | Pietronuto | A63B 59/50 473/564 |

(Continued)

*Primary Examiner* — Mitra Aryanpour

(74) *Attorney, Agent, or Firm* — Maine Cernota & Rardin

(57) ABSTRACT

An apparatus for strength training of an athlete in preparation for playing a sport that requires swinging of a bat or other implement comprises an attachment mechanism that is removably attachable to the proximal "grip" end of the implement, and a weight attachable to the attachment mechanism. A principle axis of inertia of the weight is aligned with a longitudinal axis of the implement, such that added weight does not significantly impact the athlete's use of the bat during practice drills and games. Concentration of the weight near the athlete's hand(s) also reduces risk of injury. In embodiments, additional weights can be added to the apparatus as needed. In embodiments, the apparatus includes a flexible inner member that is pressed against the shaft of the implement by threading thereon of an outer member. A longitudinal spring can be included to create tension between elements of the apparatus.

17 Claims, 10 Drawing Sheets

(56) References Cited

U.S. PATENT DOCUMENTS 4,260,150 A * 4/1981 Tabet ..... A63B 69/0002 473/437
5,295,933 A * 3/1994 Ciminski ..... A63B 21/0728 482/107
5,501,450 A * 3/1996 Nolan ..... A63B 15/00 473/256
5,624,114 A * 4/1997 Kelsey ..... A63B 60/10 473/520
5,653,440 A * 8/1997 Nolan ..... A63B 15/00 473/437
5,674,138 A * 10/1997 Nolan ..... A63B 15/00 473/457
5,741,193 A * 4/1998 Nolan ..... A63B 15/00 473/457
6,022,281 A * 2/2000 Nolan ..... A63B 15/00 473/457
6,277,040 B1 * 8/2001 Randolph ..... A63B 15/00 473/568
D523,105 S * 6/2006 Bernacchi ..... D21/725
7,169,069 B1 * 1/2007 Dalton ..... A63B 69/0002 473/568
8,944,943 B2 * 2/2015 Heiberg ..... A63B 60/28 473/568
8,968,119 B2 * 3/2015 Mattern ..... A63B 69/0002 473/437
8,998,754 B2 * 4/2015 Shocklee ..... A63B 69/0002 473/566
10,004,962 B2 * 6/2018 Codd ..... A63B 60/24 473/437
10,343,040 B2 * 7/2019 Codd ..... A63B 60/24 473/437
2004/0248676 A1 * 12/2004 Taylor ..... A63B 49/08 473/513
2014/0335967 A1 * 11/2014 Schacht ..... A63B 69/3638 473/256

* cited by examiner

STRENGTH TRAINING DEVICE FOR SWINGABLE SPORTS EQUIPMENT

RELATED APPLICATIONS

This application claims the benefit of U.S. Provisional Application No. 62/562,571, filed Sep. 25, 2017, which is herein incorporated by reference in its entirety for all purposes.

FIELD OF THE INVENTION

The invention relates to exercise equipment, and more particularly to sports-related exercise equipment.

BACKGROUND OF THE INVENTION

Many popular sports require that a participant accurately swing a bat, racket, or other elongated item of sports equipment so as to make desired contact with a ball, puck, or other projectile. Examples include the swinging of a tennis racket, a hockey stick, a lacrosse stick, a cricket bat, a baseball bat or a softball bat. For simplicity of expression, the present disclosure makes frequent reference to terms that apply to the American sport of baseball, and specifically to the swinging of baseball and/or softball bats. However, except where the context requires otherwise, it will be understood that the disclosure herein applies equally well to any sport that requires the swinging of an elongated item of sports equipment.

Generally, the improvement of an athlete's performance in a sport such as baseball or softball depends on improving hand and eye coordination, as well as toning and developing the muscles that are used when swinging the bat. In each case, playing the actual game can lead to improved performance. However, an athlete will often wish to perform specific drills and exercise that will target and develop certain skills and muscle groups more swiftly than could be expected from simply playing the game.

In particular, the muscle groups that are of primary importance when swinging a baseball or softball bat, tennis racket, etc., are the wrist, arm, and shoulder muscles, and to some degree the torso and back muscles. Some improvement can be gained in this regard simply by repeatedly swinging the bat or other sports implement, for example during batting practice. However, it is well known that an optimal approach to improving muscle strength is weight training, i.e. lifting and manipulating objects that can be varied in weight as the user's strength increases.

Therefore, athletes who wish to improve their strength as well as their stamina and coordination sometimes add weight training to their improvement regimen, in combination with aerobics, drills, and practice games. However, due to the complex motions that are executed when swinging a baseball bat, golf club, etc., it can be difficult to target the desired muscle groups using traditional weight lifting apparatus, so as to achieve the desired combination of strength and flexibility.

One approach to weight training for baseball and other "swinging" sports is to swing a weighted bat, bar, etc. in a manner that approximates the swinging of an actual bat or club, in an attempt to enhance the specific muscle groups and movement flexibilities that are primarily responsible for optimal swinging performance. However, swinging weighted clubs or bars in this manner can pose a significant risk of injury to the wrists or back, due to the high leverage and angular momentum of weight located at extended distances from the hands. Also, over-weighted bats and bars may not accurately emulate the balance and other swinging characteristics of the actual bats, rackets, or clubs that are used in the sport, and for this reason the athlete may run the risk of miss-training his or her reflexes. In addition, weight training of any kind can be time consuming and boring, such that an athlete may choose to devote his or her limited time to more enjoyable practice drills and games that sharpen reflexes and coordination, at the expense of strength training.

What is needed, therefore, is an apparatus and method for enhanced strength training of an athlete in preparation for playing a sport that requires swinging of a bat, racket, club, or other implement, whereby the strength training avoids injury and boredom, and does not unduly reduce the time available for practice drills that improve reflexes and coordination.

SUMMARY OF THE INVENTION

The present invention is an apparatus and method for enhanced strength training of an athlete in preparation for playing a sport that requires swinging of a bat, racket, club, or other implement, whereby the strength training avoids boredom and minimizes any reduction in the time available for practice drills that improve reflexes and coordination.

The disclosed apparatus includes an attachment device that can be removably attached to the proximal or "grip" end of the swinging implement, referred to herein generically as a "bat," and a weight that can be attached to the attachment device, such that a principle axis of inertia of the weight is aligned with a longitudinal principle axis of inertia of the bat, whereby the attached weight does not significantly impact the athlete's ability to grasp the bat, and to use the bat in a normal manner during practice drills. In embodiments, as the athlete's strength increases, additional weights can be added to the attachment device so as to optimize the improvement of the athlete's conditioning. In embodiments, no special modification or adaptation of the bat is required, and there is no lasting impact on the bat.

By adding weight to the bat only at a location that is close to the athlete's hands, the present invention provides weight training of the athlete's swinging muscles, with minimal impact on the balance and swinging characteristics of the bat. Accordingly, use of the apparatus during practice drills can increase the strength of the athlete, while the coordination and reflexes of the athlete are simultaneously improved. In addition, because the added weight is located near the hands, and hence relatively close to the body, the risk posed by the added weight of injury to the wrists and back is minimized.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is an apparatus and method for enhanced strength training of an athlete in preparation for playing a sport that requires swinging of a bat, racket, or other implement, whereby the strength training avoids boredom and does not unduly reduce the time available for practice drills that improve reflexes and coordination.

Figure 1A:
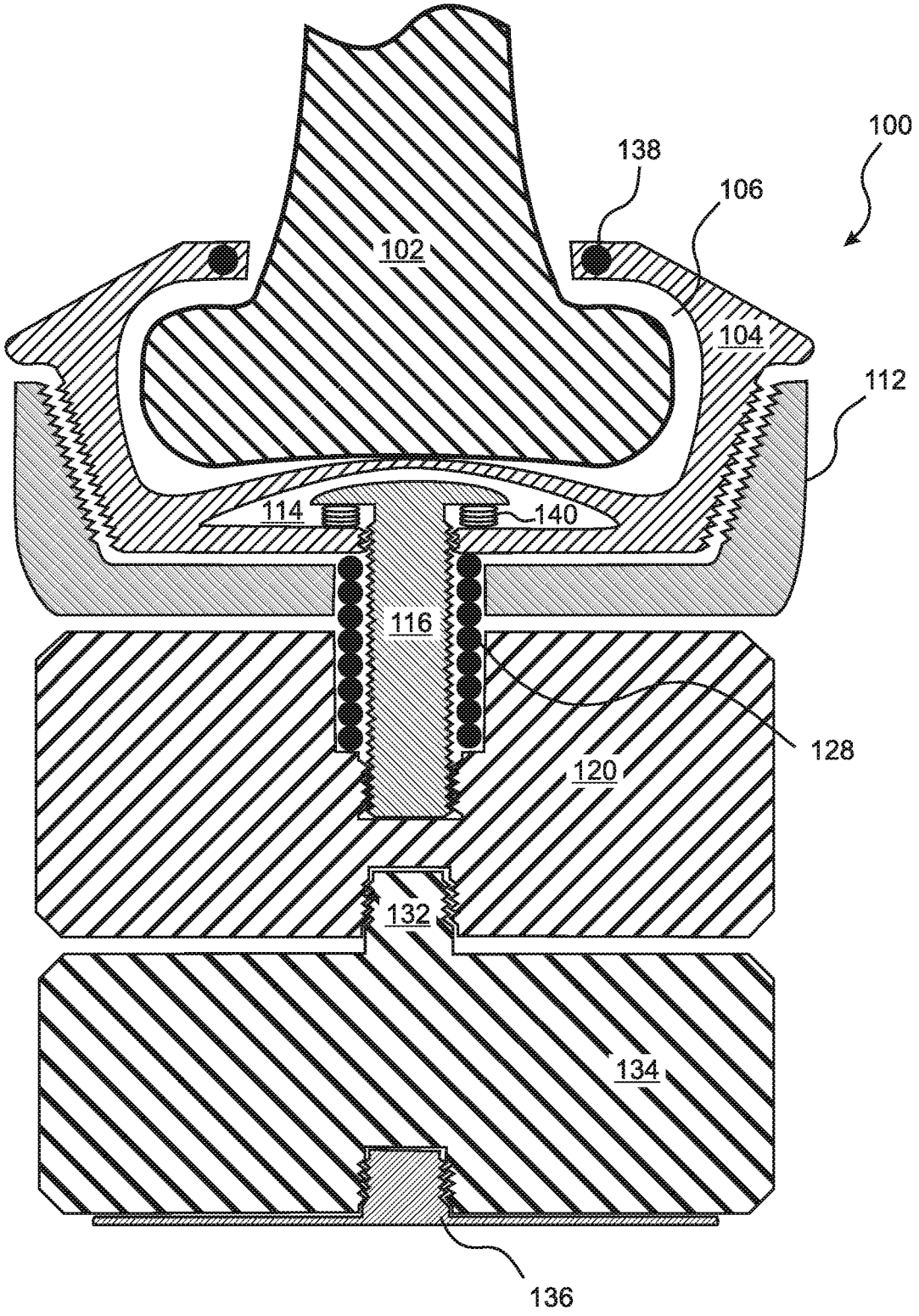
FIG. 1A is a cross-sectional illustration of a first embodiment of the disclosed apparatus.

FIG. 1A is a cross-sectional illustration of an embodiment of the invention that is applicable to use with baseball bats. With reference to FIG. 1A, and to the exploded view thereof in FIG. 1B, the disclosed apparatus includes an attachment device 100 that can be removably attached to the proximal or "grip" end 102 of the bat, such that the attached device 100 does not significantly impact the athlete's ability to grasp the bat 102, and to use the bat 102 in a normal manner during practice drills.

Figure 1B:
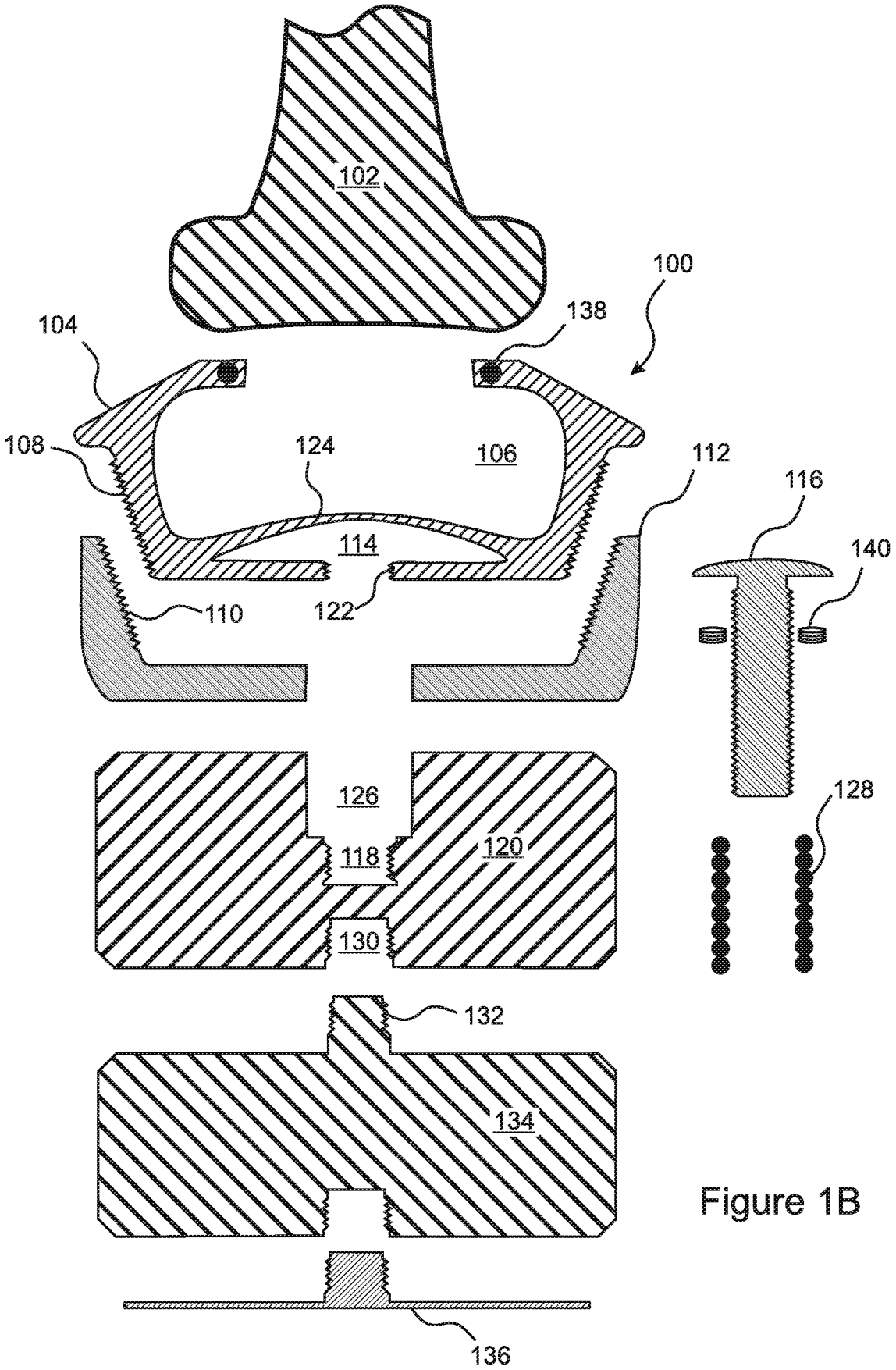
FIG. 1B is an exploded view of the embodiment of FIG. 1A.

In the embodiment of FIGS. 1A and 1B, the attachment device 100 comprises a flexible inner component 104 that is shaped so as to surround the proximal end 102 of the bat. Due to the "knob" 102 at the end of a baseball bat, the inner component 104 in FIG. 1 extends inward to form an interior chamber 106 that surrounds the knob 102. In similar embodiments that attach to the handle of an implement such as a tennis racket that does not include a knob, the flexible inner component 104 simply presses inward against the handle 102.

In the embodiment of FIGS. 1A and 1B, a portion 108 of the outer surface of the flexible component 104 is threaded. This threaded portion 108 engages with a female threaded segment 110 of a rigid or semi-rigid outer component 112. The threaded portions of the inner and outer components are angled, so that as the rigid, outer component 112 is screwed onto the flexible inner component 104, the inner component 104 is compressed against the proximal end of the bat 102.

In the embodiment of FIGS. 1A and 1B, the flexible inner component 104 further include a central cavity 114 that surrounds and retains the head of a bolt 116, a distal end of which can be threaded into a first threaded hole 118 provided in a first weight 120. The first threaded hole 118 in the first weight 120 is configured such that the distal end of the bolt 116 reaches the bottom of the hole 118 before the first weight 120 is pressed against the rear surface of the rigid outer member 112.

The entrance to the central cavity 114 of the inner component 104 is also threaded 122, so that continued rotation of the first weight 120 causes the bolt 116 to rotate and to be screwed upward into the central cavity 114 so that it is pressed against a thin upper wall 124 of the cavity 114, which in turn is pressed against a bottom end of the bat 102. This pressing by the bolt 116 against the bat 102 further stabilizes and secures the attachment device 100 and helps to align the apparatus with the central axis of the bat 102. In embodiments, the pressing of the bolt 116 against the bat 102 is enhanced and further stabilized by an upper compression spring 140 that surrounds the bolt 116 within the central cavity 114.

In the embodiment of FIGS. 1A and 1B, an enlarged opening 126 is provided above the first threaded hole 118 in the first weight 120, so that an annular cavity 126 is formed around the bolt 116 into which a lower compression spring 128 can be inserted. The lower compression spring 128 presses against the bottom of the flexible inner member 104 and against the first weight 120, thereby further stabilizing the attachment of the first weight 120 to the bolt 116.

In embodiments, as the athlete's strength increases, additional weights 134 can be added to the attachment device so as to add additional weight to the apparatus 100 and continue to optimize the improve the athlete's conditioning. In the embodiment of FIGS. 1A and 1B, a second threaded hole 130 is provided on the rear end of the first weight 120, into which a male extension 132 of a second weight 134 can be threaded so as to attach the second weight to the apparatus. Additional weights can be added in the same manner as needed.

An end cap 136 can be threaded into the threaded hole at the rear end of the final weight. In embodiments, the end cap includes writing, an illustration, and/or other indicia thereupon, such as a laser cut or stamped name and/or logo of a product manufacturer or sports organization.

In embodiments, the flexible inner component 104 further includes a metal spring clip 138 that stiffens the grip of the attachment device 100 about the shaft of the bat 102.

Note that, in the embodiment of FIGS. 1A and 1B, no special modification or adaptation of the bat is required, and there is no lasting impact on the bat due to attachment of the disclosed apparatus.

It should be noted that, in embodiments, the attachment device 100 does not fully surround knob of the bat 102, but is open on at least one side so as to allow the knob of the bat 102 to be inserted into the central chamber 106 and spring clip 138 of the inner component 104, and the head of the bolt 116 to be inserted into the central cavity 114 of the inner component 104.

Figure 2A:
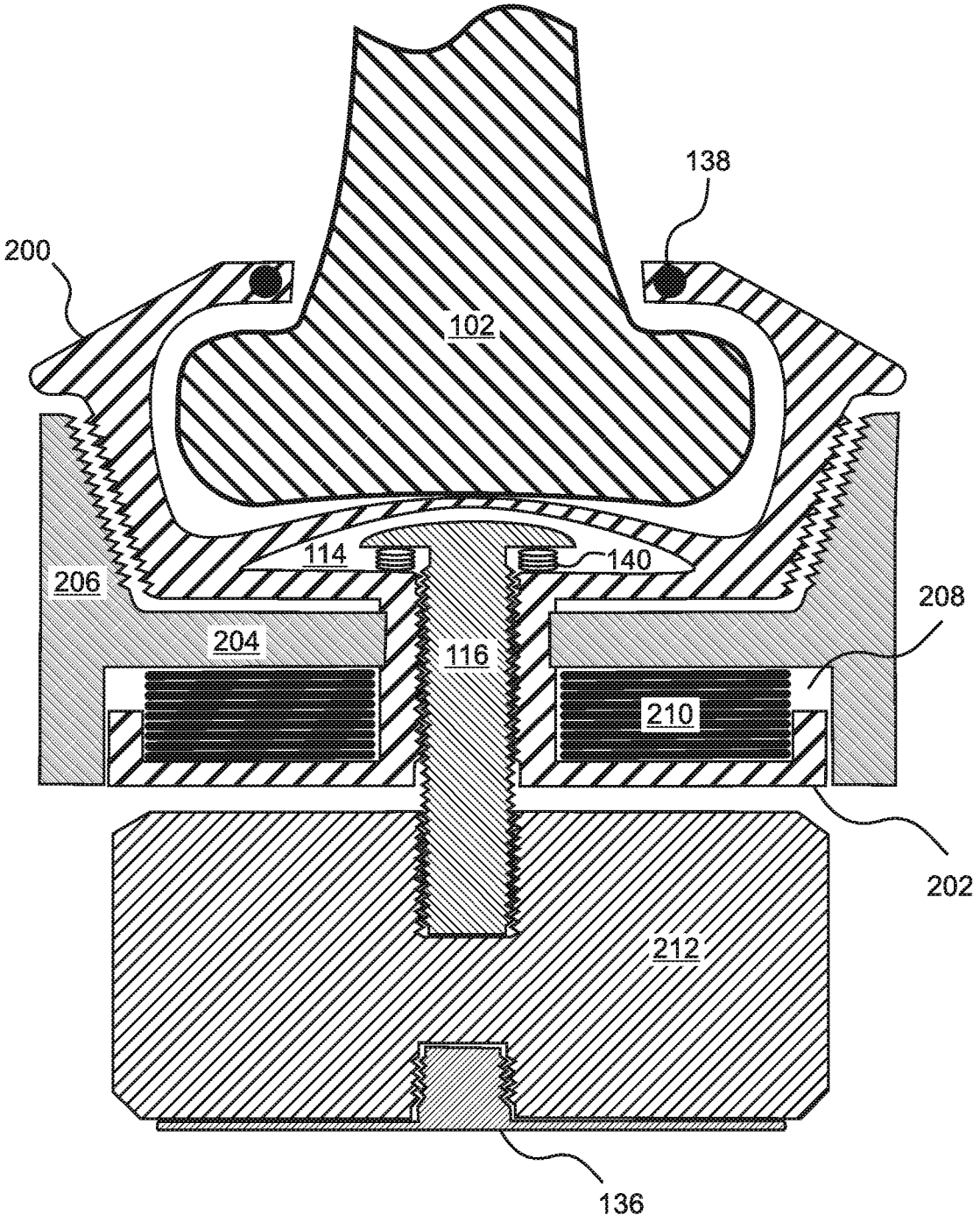
FIG. 2A is a cross-sectional illustration of a second embodiment of the disclosed apparatus.
Figure 2B:
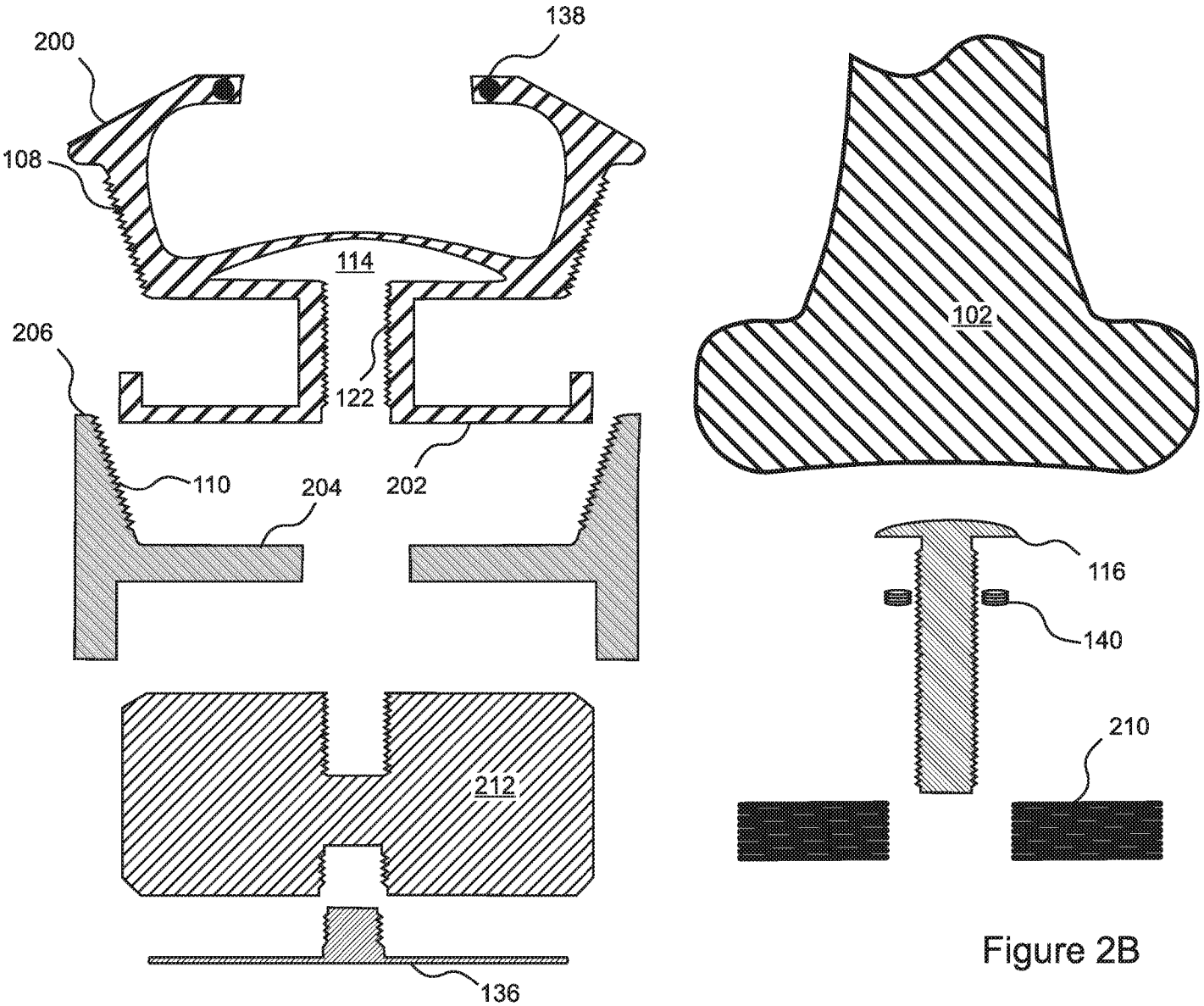
FIG. 2B is an exploded view of the embodiment of FIG. 2A.

FIGS. 2A and 2B are cross-sectional illustrations of a second embodiment of the present invention. In this embodiment, a lower structure 202 of the flexible inner component 200 extends below the bottom 204 of the rigid outer member 206, such that a chamber 208 is formed therebetween. A compression spring 210 is inserted in the chamber 208 so that it presses against the lower structure 202 of the inner component 200 and the bottom 204 of the outer component 206. Accordingly, the weight 212 in this embodiment does not include a cavity for insertion of a compression spring.

Figure 3A:
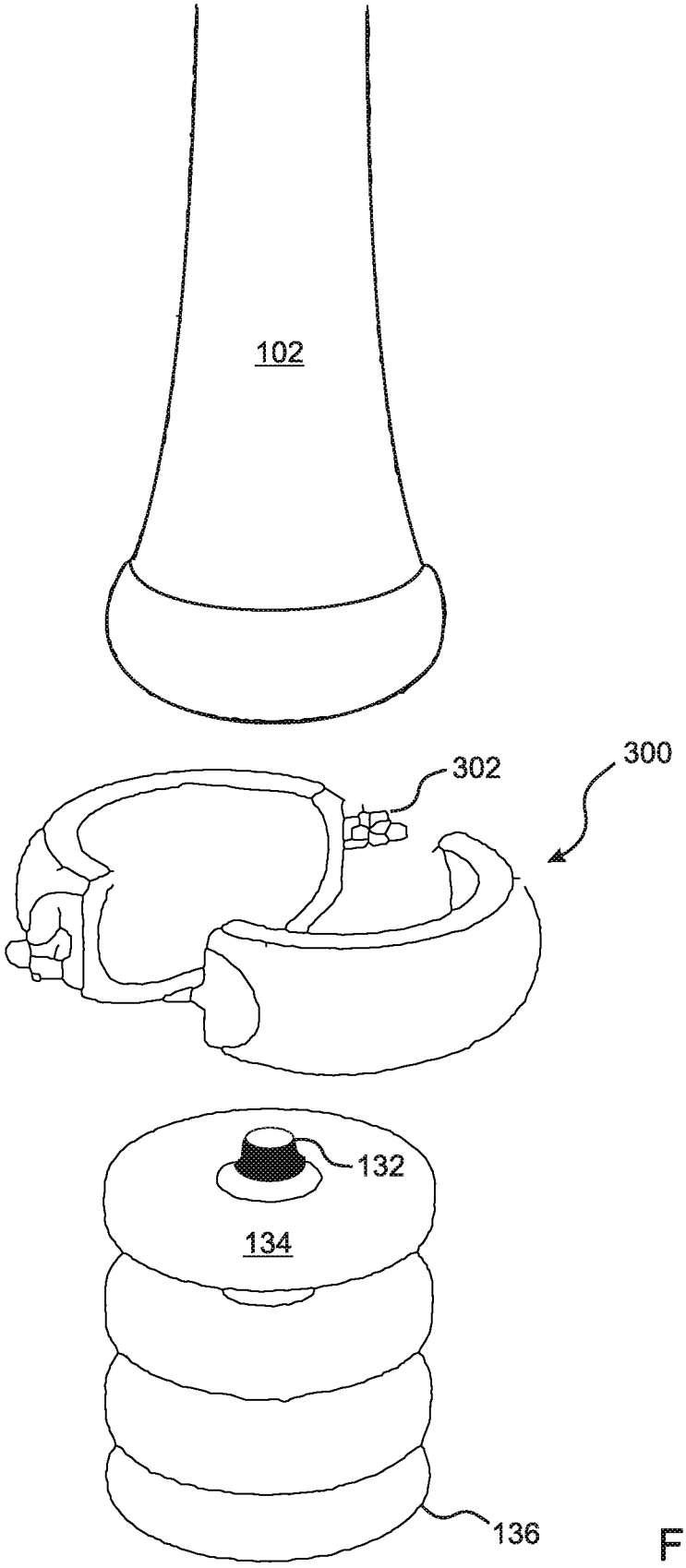
FIG. 3A is a perspective exploded view of a third embodiment of the disclosed apparatus.
Figure 3B:
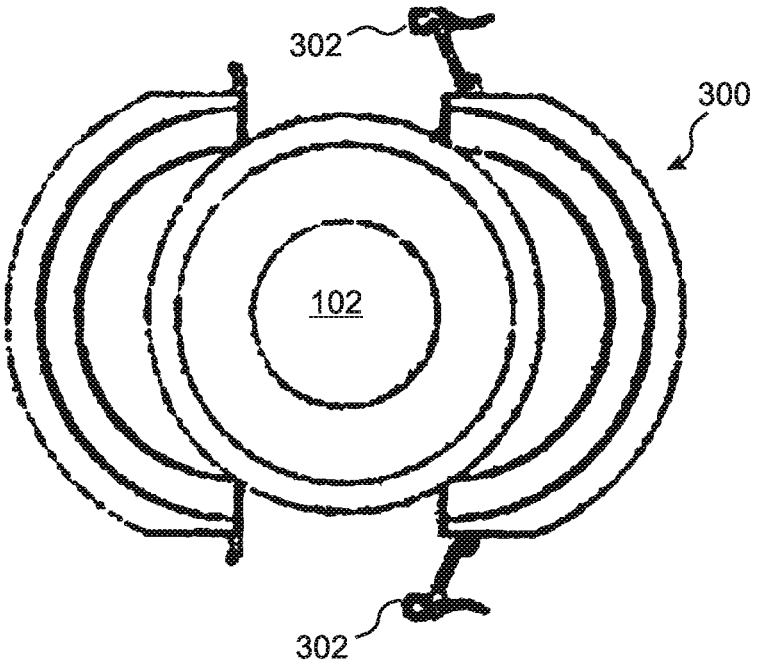
FIG. 3B is a top view of the embodiment of FIG. 3A.
Figure 3C:
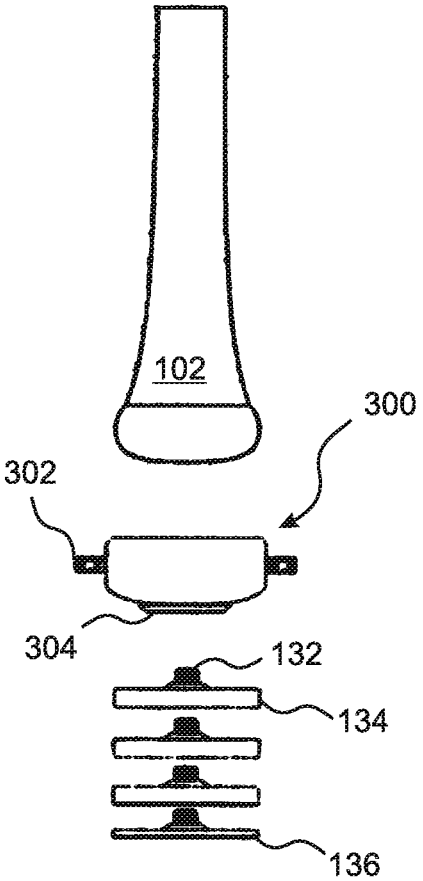
FIG. 3C is a side view of the embodiment of FIG. 3A.
Figure 3D:
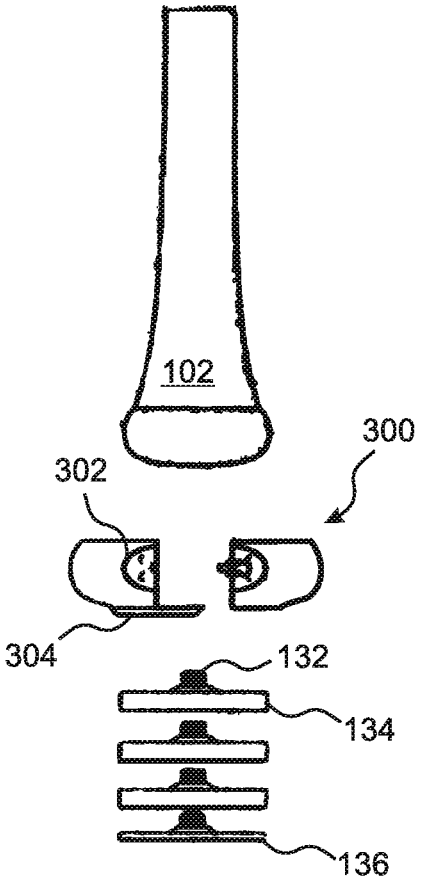
FIG. 3D is a side view of the embodiment of FIG. 3A.

FIG. 3A is a perspective exploded view of a third embodiment of the present invention. FIGS. 3B, 3C, and 3D are top, front, and side views respectively of the embodiment of FIG. 3A. This embodiment comprises a split-ring clamp 300 that includes two half-rings that are attached at both ends by clamps 302, wing nut and bolt attachment, or another attachment mechanism as is known in the art. The diameter of the clamp 300 is less than the diameter of the base of the bat 102, such that engagement of the clamping mechanism causes the clamp 300 to press firmly against the bat. One or more weights 134 are then attached to a base 304 of the clamp 300 by a threaded male extension 132.

With reference to FIG. 4, in other embodiments the "flexible component" 400 is actually made from a rigid material, wherein the upper portion thereof comprises a plurality of segments 402 that are hinged 404 near a lower periphery thereof. In some of these embodiments, the bolt 406, which can be a plug (i.e. need not be threaded), serves to spread the hinged segments 402 apart when it is lowered. In the embodiment of FIG. 4, the plug 406 is attached to a chuck 408, which is threaded onto a first threaded segment 410. As the chuck 408 is rotated away from the segments 402, the plug 406 spreads the segments 402 apart, and when the chuck 408 is rotated toward the segments 402, it forces them to converge so that they grasp the end of the bat, hockey stick, or other swingable implement 102. In the embodiment of FIG. 4, the "flexible" portion 400 includes three hinged segments 402 that are equally spaced apart. The embodiment further includes a second threaded segment 412 formed on or attached to the bottom of the chuck 408 to which a weight 414 can be attached. The weight 414 includes a third threaded segment 416 that can be covered by a cap 418. In embodiments, additional weights can be attached between the chuck 408 and the end cap 418.

Figure 4A:
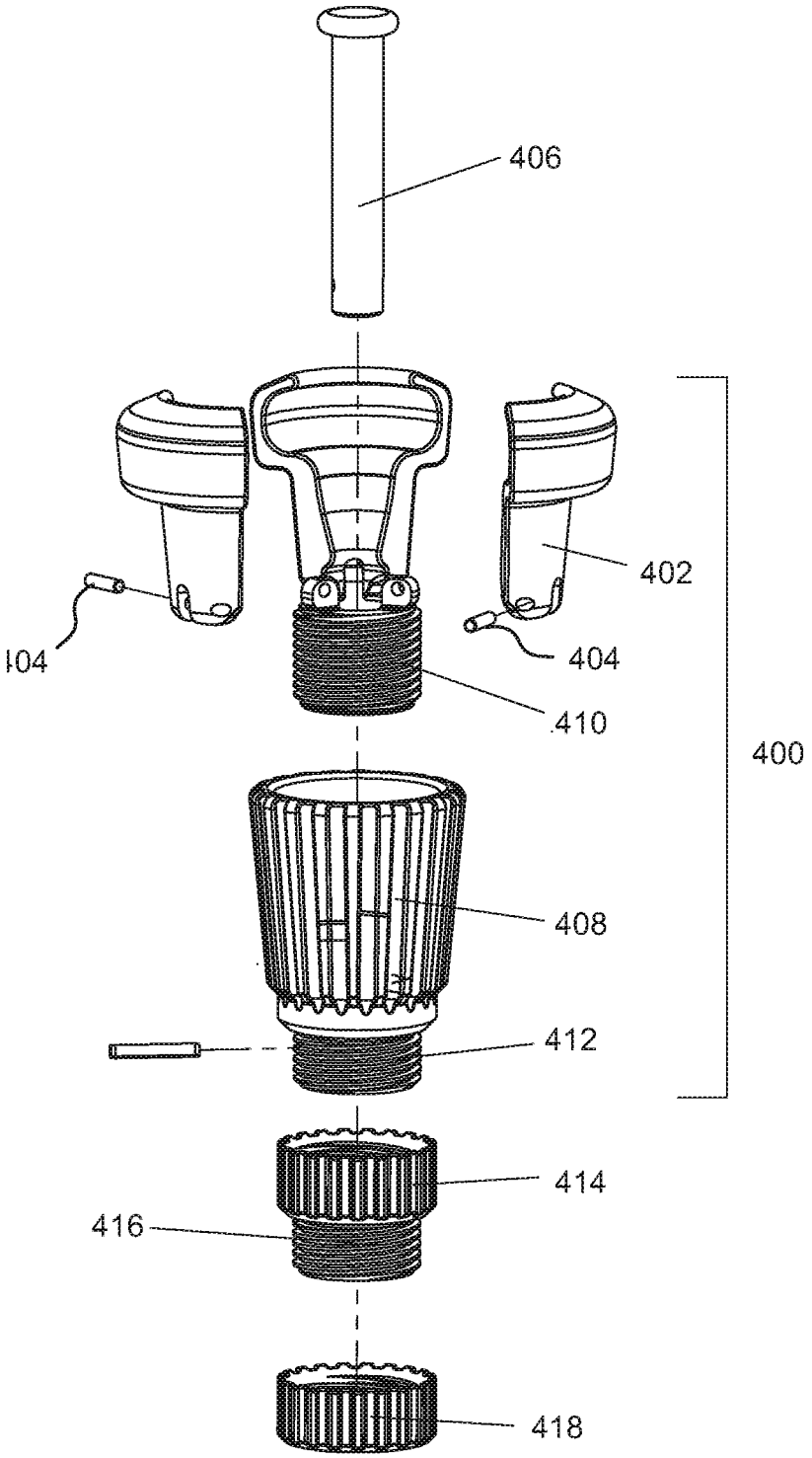
FIG. 4A is a an exploded, perspective view of an embodiment in which the attachment mechanism includes three hinged sections that are clamped by a chuck against the bottom of a swingable implement.
Figure 4B:
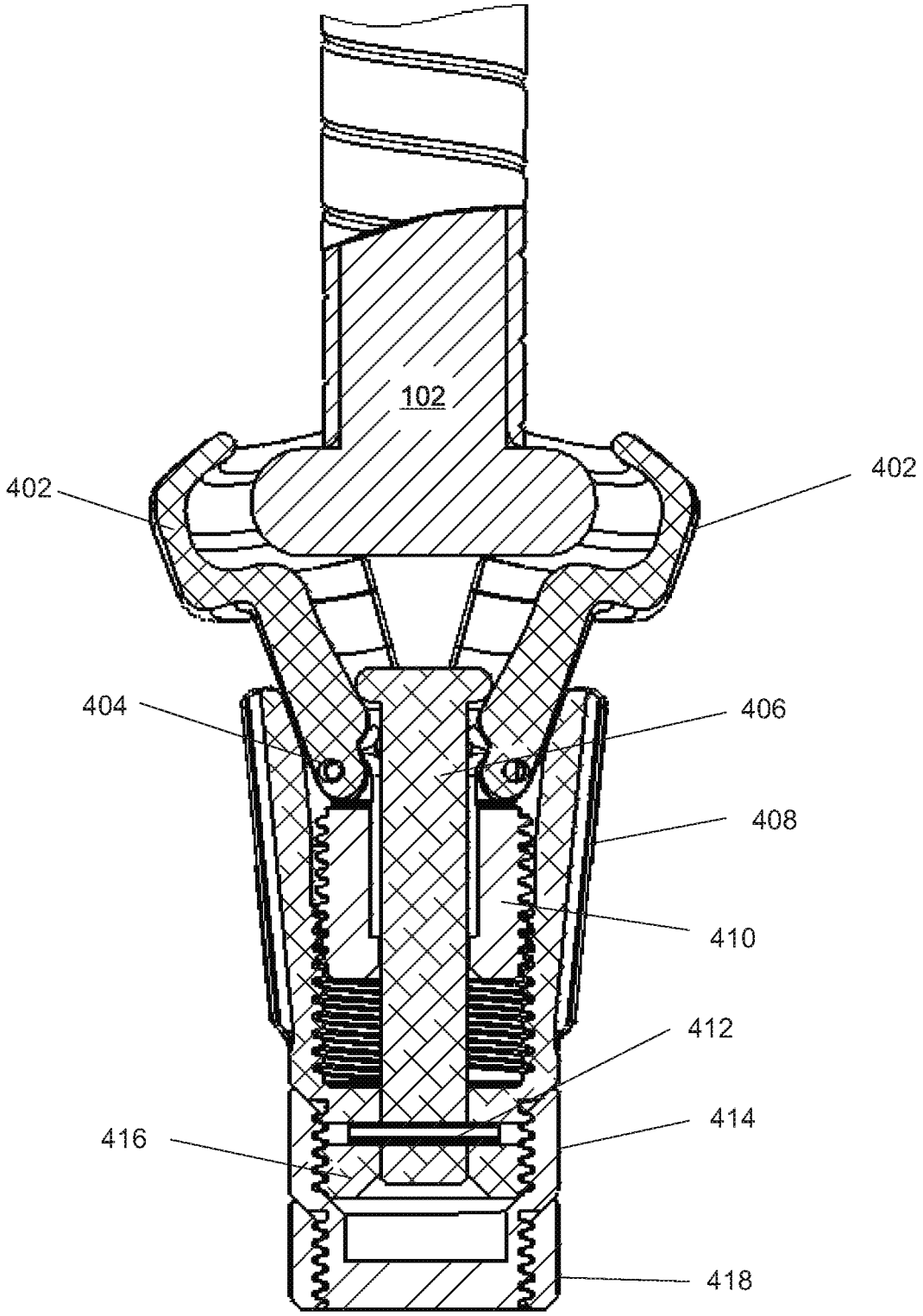
FIG. 4B is a sectional view of the embodiment of FIG. 4A, shown in preparation for attachment to the end 102 of a baseball bat.
Figure 4C:
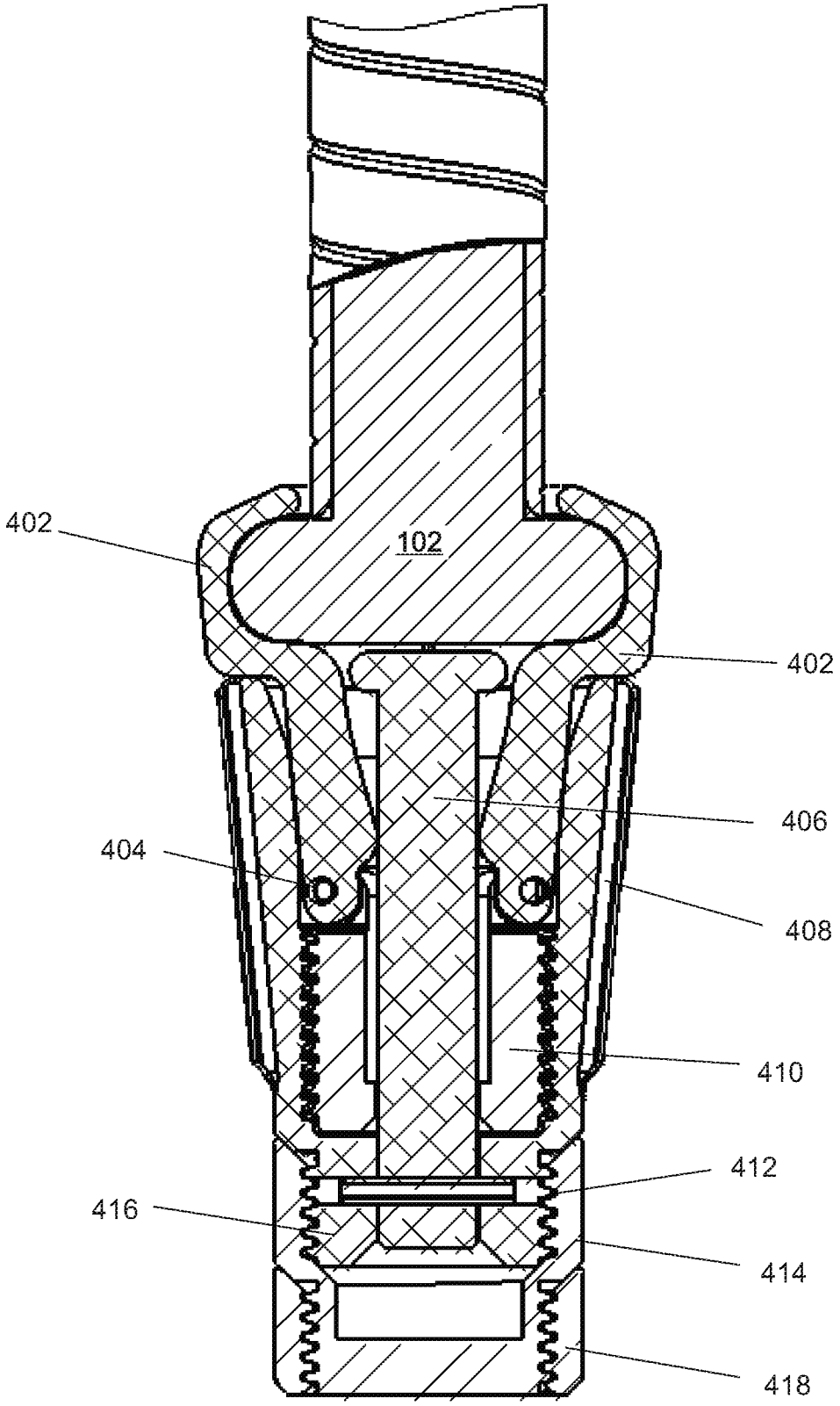
FIG. 4C is a sectional view similar to FIG. 4B, but showing the mechanism 400 attached to the bat 102.

FIG. 4B is a sectional view of the embodiment of FIG. 4A, shown in preparation for attachment to the end 102 of a baseball bat. FIG. 4C is a sectional view similar to FIG. 4B, but showing the mechanism 400 attached to the bat 102.

Similar embodiments are configured for attachment to the proximal end of the handle of a tennis racket, hockey stick, golf club, cricket bat, and other swingable sports apparatus.

Figure 5:
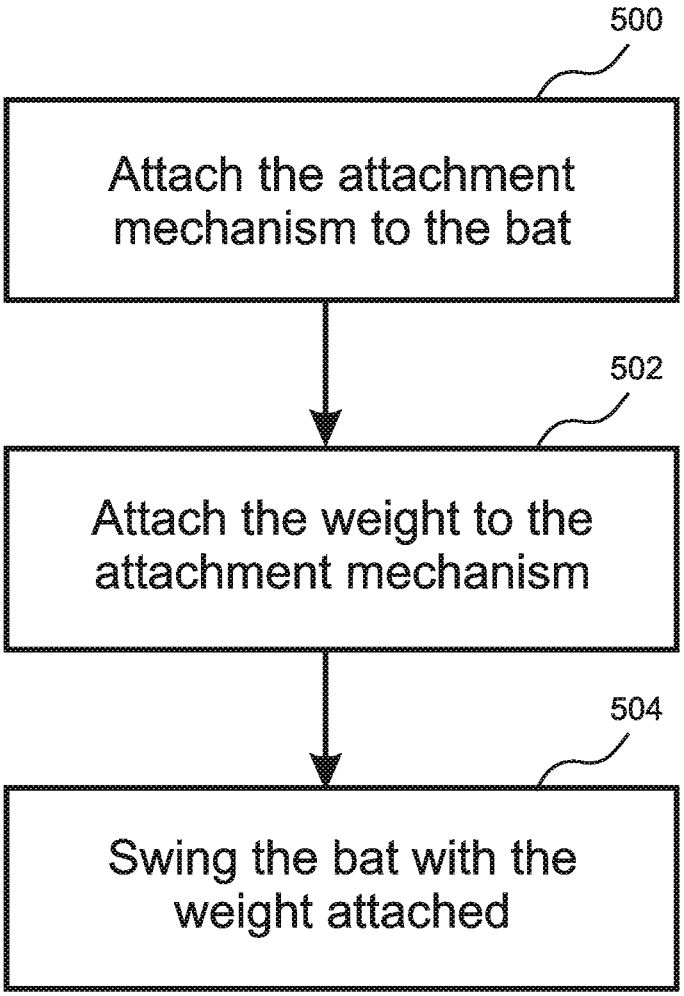
FIG. 5 is a flow diagram that illustrates a method embodiment of the disclosed invention.

FIG. 5 illustrates a method of using the disclosed apparatus. According to the illustrated embodiment, the attachment mechanism of the disclosed apparatus is attached 500 to the proximal end of an unmodified bat or other swingable implement. A "first" weight is then attached 502 to the attachment mechanism. In various embodiments, a plurality of "first" weights is provided from which a first weight of a desired heaviness is selected. In embodiments, additional weights can be attached to the first weight as needed.

Finally, the athlete grasps the bat at the proximal end, and swings the bat 504 with the attached weight. In embodiments, the athlete swings the bat with attached weight in a manner that is as close as possible to the manner in which the bat would be swung, without the added weight, during play of the game. In embodiments, the athlete swings the bat with attached weight(s) during a practice drill that is designed to also improve the athlete's coordination and skill at playing the game. In some embodiments, the athlete swings the bat with the added weight(s) during play of a practice game.

By adding weight to the bat or other swingable apparatus only at a location that is close to the athlete's hands, and in an alignment such that a principle axis of inertia of the weight is in alignment with the longitudinal principle axis of inertia of the bat, the present invention provides weight training of the athlete's wrists, forearms, shoulders, and other swinging muscles with minimal impact on the balance and swinging characteristics of the bat. Accordingly, use of the apparatus during practice drills can increase the strength of the athlete, while the coordination and reflexes of the athlete are simultaneously improved.

In addition, because the added weight is located near the hands, and hence relatively close to the body, the risk of injury to the wrists or back due to swinging the added weight is minimized.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

I claim:

1. An apparatus for strength training of an athlete in preparation for playing a sport that requires the athlete to grasp a proximal end of an elongated, swingable implement and to swing said implement, the apparatus comprising:

an attachment mechanism that is able to surround and clamp to the proximal end of the swingable implement, the attachment mechanism comprising a plurality of segments that are attachable hingeably below the proximal end of the swingable implement and configured for placement surrounding the proximal end of the swingable implement, whereby convergence of the plurality of segments radially inward compresses and clamps the proximal end of the swingable implement therebetween; and a first weight that is attachable to the swingable implement by the attachment mechanism such that a principle axis of inertia of the first weight is aligned with a longitudinal principle axis of inertia of the swingable implements wherein the attachment mechanism comprises an inner component having a threaded outer surface and an outer component having a threaded inner surface, said threaded surfaces being angled such that threaded advancement of the outer component onto the inner component presses the inner component radially inward against the proximal end of the swingable implement.

2. The apparatus of claim 1, wherein the attachment mechanism does not require modification of the swingable implement, and wherein the swingable implement is not affected by attachment thereto and removal therefrom of the attachment mechanism.

3. The apparatus of claim 1, further comprising a second weight that is attachable to the first weight such that a principle axis of inertia of the second weight is aligned with the longitudinal principle axis of inertia of the swingable implement.

4. The apparatus of claim 3, wherein the second weight is attachable to the first weight by means of threading of a threaded shaft extending from one of the first and second weights into a corresponding threaded hole in the other of the first and second weights.

5. The apparatus of claim 1, wherein the attachment mechanism further comprises a spring that applies a longitudinal force to elements of the apparatus.

6. The apparatus of claim 1, wherein the attachment mechanism further comprises a rod extending from a lower surface thereof that can be threaded or inserted and pinned into a hole in the first weight.

7. The apparatus of claim 1, wherein the attachment mechanism completely surrounds the proximal end of the swingable implement.

8. The apparatus of claim 1, wherein the attachment mechanism partially surrounds the swingable implement, while allowing the proximal end of the swingable implement to be inserted laterally into the attachment mechanism.

9. The apparatus of claim 8, further comprising a metal reinforcing clip cooperative with an upper rim of the inner component and configured to enhance attachment of the attachment mechanism to the swingable implement.

10. The apparatus of claim 1, wherein the attachment mechanism further comprises:

a male threaded element proximal to the attachable segments such that the attachable segments are between the threaded element and the proximal end of the swingable implement; and a female threaded chuck rotatable about the male threaded element so as to advance the chuck toward the attachable segments, thereby forcing the attachable segments to converge onto the proximal end of the swingable implement.

11. The apparatus of claim 1, wherein the segments of the attachment mechanism are attachable below the proximal end of the swingable implement by hinged attachment.

12. The apparatus of claim 1, wherein the attachment mechanism further comprises a central bolt or plug configured to be lowered and thereby to spread the segments apart during attachment and removal of the attachment mechanism, and to be raised and thereby allow the segments to be pressed against the proximal end of the swingable implement when the attachment mechanism is engaged with the proximal end of the swingable implement.

13. The apparatus of claim 12, wherein the bolt or plug is configured to press against a lower surface of the proximal end of the swingable implement when the attachment mechanism is engaged with the proximal end of the swingable implement.

14. A method for improving the performance of an athlete in playing a sport that requires the athlete to grasp a proximal end of an elongated, swingable implement and to swing said swingable implement, the method comprising:

providing an apparatus according to claim 1;

attaching the attachment mechanism to the proximal end of the swingable implement;

grasping by the athlete of the proximal end of the swingable implement;

attaching of the first weight to the attachment mechanism; and swinging of the swingable implement by the athlete.

15. The method of claim 14, further comprising:

providing a second weight according to claim 3 or claim 4; and attaching the second weight to the first weight.

16. The method of claim 14, wherein swinging the swingable implement includes swinging the swingable implement in a manner that closely approximates or is equivalent to a manner in which the swingable implement is swung during play of the sport.

17. The method of claim 14, wherein swinging the swingable implement includes swinging the swingable implement during execution of a drill or practice game that is directed to improving the athlete's skill in playing the sport.

* * * * *